US008292655B1

(12) United States Patent
Ling et al.

(10) Patent No.: US 8,292,655 B1
(45) Date of Patent: Oct. 23, 2012

(54) INNOVATIVE CABLE TERMINATION SCHEME

(75) Inventors: Yun Ling, Portland, OR (US); Daniel T. Tong, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 19 days.

(21) Appl. No.: 13/078,659

(22) Filed: Apr. 1, 2011

(51) Int. Cl.
*H01R 9/09* (2006.01)

(52) U.S. Cl. ..... 439/497; 439/579

(58) Field of Classification Search ..... 439/497, 439/581, 579
See application file for complete search history.

(56) References Cited

U.S. PATENT DOCUMENTS

| | | | | |
|---|---|---|---|---|
| 4,602,832 | A * | 7/1986 | Cunningham et al. | 439/108 |
| 5,241,135 | A * | 8/1993 | Fetzer | 174/88 R |
| 6,540,548 | B1 * | 4/2003 | Zhang | 439/493 |
| 6,896,308 | B2 * | 5/2005 | Okanda et al. | 296/37.12 |
| 7,520,774 | B2 * | 4/2009 | Watanabe | 439/493 |
| 2004/0067680 | A1 * | 4/2004 | Wu | 439/497 |

* cited by examiner

*Primary Examiner* — Gary F. Paumen
(74) *Attorney, Agent, or Firm* — Kevin A. Reif

(57) ABSTRACT

Embodiments of the invention use a small piece of flex or rigid PCB as the cable plug. The wires of the cable are soldered onto the pads on the PCB with the pads so arranged that all the ground pads are tied together without needing a separate grounding bar. The signal and GND pads are so aligned such that minimum strip length is required for soldering and the symmetry of the differential signals is maintained.

19 Claims, 2 Drawing Sheets

INNOVATIVE CABLE TERMINATION SCHEME

FIELD OF THE INVENTION

Embodiments of the present invention are directed to cable termination and, more particularly, to cable wire termination for high speed interfaces.

BACKGROUND INFORMATION

Electrical cables are often used to carry electrical data signals or power from one device to another. At some point the cable must be terminated where it connects to the device or to a plug or connector which may be plugged into the device. It is well known that high speed electrical performance heavily depends on proper cable termination in order to insure mechanical and electrical integrity.

Referring to FIG. 1, there is illustrated a popular method for terminating cables, such as micro-coaxial cables, commonly referred to simply as micro-coax. A micro-coax cable 100 may include a central signal wire 102 covered in a signal wire insulator 104, a conductive coaxial shield 106 surrounding the insulator 104, a shield insulator 107 may be present, and finally an outer insulative sheath 108. The cables 100 are stripped as shown. Often, the cables 100 occur in differential pairs with one cable signal wire 102 carrying signal Ss+ and the other carrying Ss−.

One current cable termination solution typically involves soldering the wires 102 to stamp-and-formed contacts 112 in a cable plug. In some cases, a small piece of printed circuit board (PCB) 110 may be inserted in the cable plug and the wires 102 are soldered 114 onto the PCB pads. The contacts or the PCB pads are arranged in a row, and long strip length of wire 102 is often necessary in order to solder the wire 102 onto the contacts or pads 112. In the case of a micro-coax cable, an additional metal ground bar 116 is needed to tie the cable shields 106 to the ground 118. The ground bar 116 may be a conductive metal strip runs across all of the cable shields and ties them to a ground cable 118, in some cases.

BRIEF DESCRIPTION OF THE DRAWINGS

The foregoing and a better understanding of the present invention may become apparent from the following detailed description of arrangements and example embodiments and the claims when read in connection with the accompanying drawings, all forming a part of the disclosure of this invention. While the foregoing and following written and illustrated disclosure focuses on disclosing arrangements and example embodiments of the invention, it should be clearly understood that the same is by way of illustration and example only and the invention is not limited thereto.

DETAILED DESCRIPTION

It is well known that cable assembly high speed electrical performance heavily depends on cable termination. Developing a simple method for cable wire termination will improve the cable assembly high speed performance to support high speed interfaces such as SATA3, USB3, and PCIe3 that may involve cables. Embodiments of the invention provide a solution to allow cable wires to be cleanly terminated onto a cable plug with a minimum strip length (i.e. the length over which the shielding is removed).

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 2:
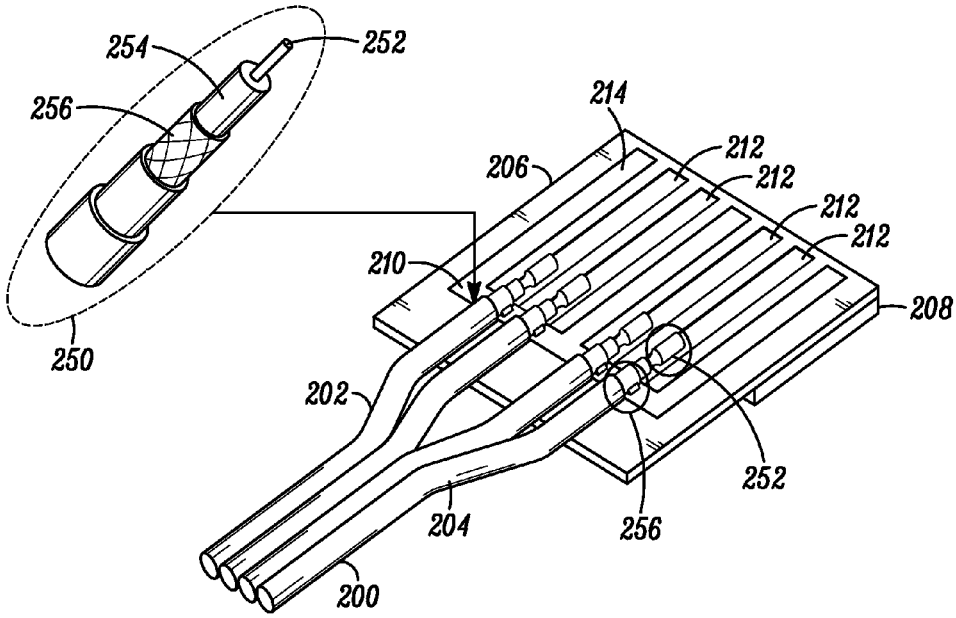
FIG. 2 is a plan view of a wire termination device for a coaxial or micro-coaxial cable according to one embodiment.

Referring now to FIG. 2, there is shown one embodiment of the invention for cable termination. As shown, a plurality of cables 200 may be terminated. For illustrative purposes, four cables 200 are shown comprising two differential pairs 202 and 204. Of course in practice any number of cables or a single cable may be terminated within the teachings of the invention. In one embodiment a small piece of flex or rigid printed circuit board (PCB) 206 may be used as for a cable plug 208. The cable plug 208 may be inserted into a receptacle connector on, for example, a motherboard. The PCB 206 may be of one or more layers with or without a ground plane.

Parallel traces comprising a one or more differential pair signal pads 212 may be patterned or stamped on the PCB 206. A ground (GND) network 214 may also be patterned on the PCB 206 symmetrically surrounding the differential signal pads 212. As shown, the ground network 214 surrounds each of the differential pairs 212 on at least three sides with a parallel strips of the ground network 214 on either side of the parallel traces forming the differential pair 212 and perpendicular part of the ground network 214 lying in front of the differential pairs 212.

In one embodiment, a wire termination area 210 includes the perpendicular part of the GND network 214 which lies in front of the differential signal pads 212. The micro-coax cables 200 may be stripped as shown in the bubble 250 with a length of the inner core 252 protruding out in front followed by a length of the core insulator 254, followed by an exposed length of the coax shield 256. When terminating a micro-coax cable onto the PCB 206, the coax shield 256 in front of the conductor core 252 is soldered onto the GND pad in the termination area 210 and becomes a part of the GND network 214. The conductor core 252 is soldered onto the signal pad on one of the differential pairs 212, in-line with the shield 256.

Figure 1:
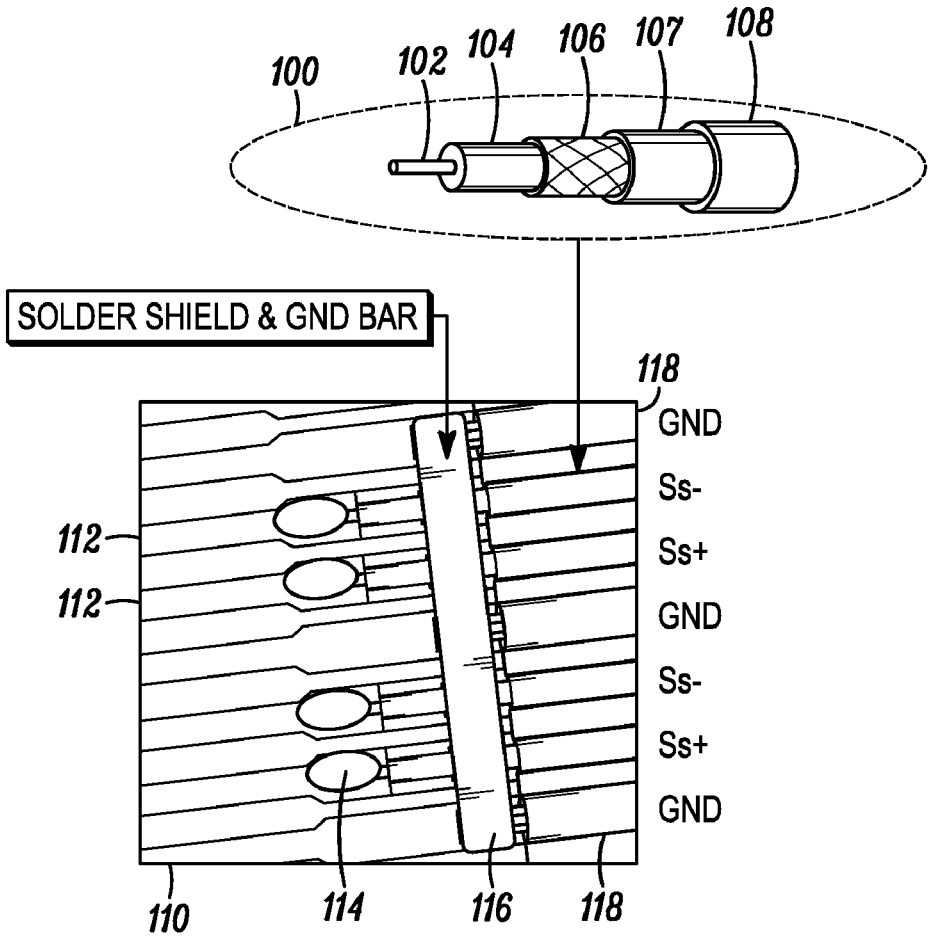
FIG. 1 is a plan view of a typical wire termination scheme.

There are many advantages to this cable termination scheme including, there is no longer the need to have a GND bar 116 to tie shields to GND, as shown in FIG. 1, saving materials and costs, In addition, the GND traces/pads 214 on the PCB 206 are directly in contact with the coax cable shields 256 forming a smooth return path. Further, the GND/guide trace network 214 on the PCB 206, and if necessary, the GND plane on the PCB 206 further improves return path, reducing crosstalk and emission.

Figure 3:
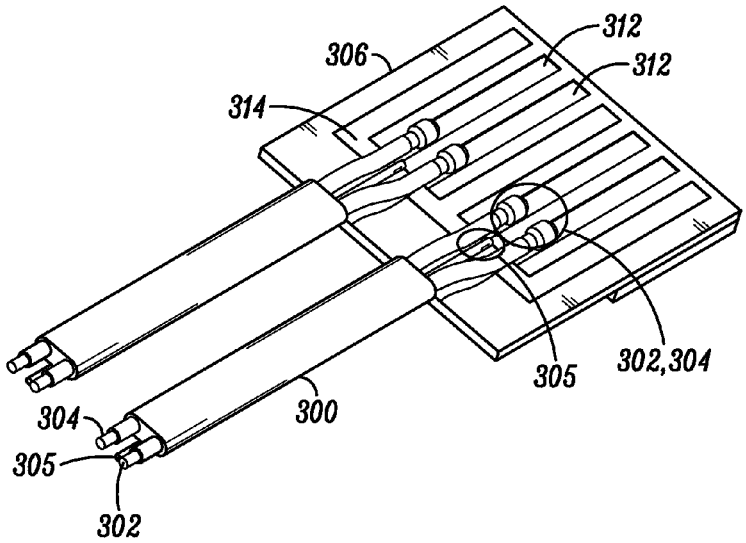
FIG. 3 is a plan view of a wire termination device for a twinax or twisted pair cable according to one embodiment.

FIG. 3 shows yet another embodiment of the invention for twinax or twisted pair cables. The termination is done similarly to the micro-coax case, as shown in FIG. 2. As before, parallel traces comprising a one or more differential pair signal pads 312 may be patterned or stamped on the PCB 306. A ground (GND) network 314 may also be patterned on the PCB 306 symmetrically surrounding the differential signal pads 312. As shown, the ground network 314 surrounds each of the differential pairs 312 on at least three sides.

In this case, each cable 300 may comprise first wire 302 and a second wire 304 forming the twinax or the twisted differential pair. In addition a third wire, known as the drain wire, 305 may also make up part of the cable 300. The differential pair 302 and 304 of the cable 300 is soldered onto the differential pads/traces 312 on the PCB 306. The drain wire 305 of the cable differential pair is soldered onto the GND network 314 as shown.

Again, this termination scheme has many advantages including, the symmetry of differential pair 302 and 304 is maintained in the termination area; this is usually not the case for other termination schemes. Plus, the termination is very clean with minimum wire stripping and no wire cross-over. The termination area may be protected with over-molding or potting, which is not shown in the diagram.

Thus, according to embodiments flex or rigid PCB may be used for wire termination with all GND pads tied together. The GND and signal solder pads are aligned in-line such that the symmetry of differential signaling is maintained and the cable stripped length is kept to a minimum. Further, in the case of micro-coax cable, there is no need for grounding bar to tie the ground together.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An apparatus, comprising:
a substrate;
at least one pair of parallel differential signal lines on the substrate;
a ground network on the substrate, the ground network having strips parallel on either side of the differential signal lines and a strip lying in front of and perpendicular to the differential signal lines,
wherein the ground network surrounds the differential signal lines on at least three sides.

2. The apparatus as recited in claim 1 wherein the substrate comprises a rigid printed circuit board (PCB).

3. The apparatus as recited in claim 1 wherein the substrate comprises a flexible printed circuit board (PCB).

4. The apparatus as recited in claim 1 further comprising:
a coaxial cable having an inner core and a coaxial shield,
wherein the inner core is connected one of the differential signal lines, and
the coaxial shield is connected to the ground network at the strip lying in front of and perpendicular to the differential signal lines.

5. The apparatus as recited in claim 4 further comprising:
a second coaxial cable having an inner core and a coaxial shield,
wherein the inner core is connected a second one of the differential signal lines, and
the coaxial shield is connected to the ground network at the strip lying in front of and perpendicular to the differential signal lines.

6. The apparatus as recited in claim 4 wherein the coaxial cable is a micro-coaxial cable.

7. The apparatus as recited in claim 1 further comprising:
a twisted pair or a twinax pair having first and second signal lines and a drain wire,
wherein the first signal line is connected to one of the differential signal lines and the second signal line is connected to the other of the differential signal lines, and
the drain wire is connected to the ground network at the strip lying in front of and perpendicular to the differential signal lines.

8. A method, comprising:
providing a substrate;
patterning at least one pair of parallel differential signal lines on the substrate; and
patterning a ground network on the substrate, the ground network having strips parallel on either side of the differential signal lines and a strip lying in front of and perpendicular to the differential signal lines,
wherein the ground network surrounds the differential signal lines on at least three sides.

9. The method as recited in claim 8 wherein the substrate comprises a rigid printed circuit board (PCB).

10. The method as recited in claim 8 wherein the substrate comprises a flexible printed circuit board (PCB).

11. The method as recited in claim 8 further comprising:
providing a coaxial cable having an inner core and a coaxial shield,
connecting the inner to one of the differential signal lines, and
connecting the coaxial shield to the ground network at the strip lying in front of and perpendicular to the differential signal lines.

12. The method as recited in claim 11 further comprising:
providing a second coaxial cable having an inner core and a coaxial shield,
connecting the inner core to a second one of the differential signal lines, and
connecting the coaxial shield to the ground network at the strip lying in front of and perpendicular to the differential signal lines.

13. The method as recited in claim 11 wherein the coaxial cable is a micro-coaxial cable.

14. The method as recited in claim 11 further comprising:
providing a twisted pair or a twinax pair having first and second signal lines and a drain wire,
connecting the first signal line to one of the differential signal lines and connecting the second signal to the other of the differential signal lines, and
connecting the drain wire to the ground network at the strip lying in front of and perpendicular to the differential signal lines.

15. A system, comprising:
a cable termination plug to be plugged into a receptacle, the plug comprising a substrate;
at least one pair of parallel differential signal lines on the substrate;
a ground network on the substrate, the ground network having strips parallel on either side of the differential signal lines and a strip lying in front of and perpendicular to the differential signal lines,
wherein the ground network surrounds the differential signal lines on at least three sides.

16. The system as recited in claim 15 further comprising:

a coaxial cable having an inner core and a coaxial shield, wherein the inner core is connected one of the differential signal lines, and the coaxial shield is connected to the ground network at the strip lying in front of and perpendicular to the differential signal lines.

17. The system as recited in claim 16 further comprising:

a second coaxial cable having an inner core and a coaxial shield, wherein the inner core is connected a second one of the differential signal lines, and the coaxial shield is connected to the ground network at the strip lying in front of and perpendicular to the differential signal lines.

18. The system as recited in claim 16 wherein the coaxial cable is a micro-coaxial cable.

19. The system as recited in claim 15 further comprising:

a twisted pair or a twinax pair having first and second signal lines and a drain wire, wherein the first signal line is connected to one of the differential signal lines and the second signal line is connected to the other of the differential signal lines, and the drain wire is connected to the ground network at the strip lying in front of and perpendicular to the differential signal lines.

* * * * *